US006592390B1

(12) United States Patent
Davis et al.

(10) Patent No.: US 6,592,390 B1
(45) Date of Patent: Jul. 15, 2003

(54) HMZD CABLE CONNECTOR LATCH ASSEMBLY

(75) Inventors: Wayne Samuel Davis, Harrisburg, PA (US); Robert Neil Whiteman, Jr., Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/136,725

(22) Filed: Apr. 30, 2002

(51) Int. Cl.[7] ..... H01R 13/627
(52) U.S. Cl. ..... 439/352
(58) Field of Search ..... 439/352, 350, 439/351, 353–358

(56) References Cited

U.S. PATENT DOCUMENTS

| | | | | |
|---|---|---|---|---|
| 4,026,624 | A | 5/1977 | Boag | |
| 4,548,455 | A | 10/1985 | Ezure | |
| 4,632,121 | A | 12/1986 | Johnson et al. | |
| 4,681,387 | A | 7/1987 | Paddock | |
| 4,726,783 | A | 2/1988 | Nakazawa et al. | |
| 4,925,398 | A | 5/1990 | Samejima et al. | |
| 5,207,593 | A | 5/1993 | Bogiel | |
| 5,318,457 | A | 6/1994 | Harting et al. | |
| 5,330,366 | A | 7/1994 | Tsuji et al. | |
| 5,334,041 | A | 8/1994 | Anbo et al. | |
| 5,634,809 | A | 6/1997 | Hirai | |
| 5,919,056 | A | 7/1999 | Suzuki et al. | |
| 5,951,316 | A | 9/1999 | Kawano et al. | |
| 6,030,244 | A | 2/2000 | Buckheit et al. | |
| 6,113,416 | A | 9/2000 | Holzer | |
| 6,149,451 | A | 11/2000 | Weber | |
| 6,174,190 | B1 | 1/2001 | Tharp et al. | |
| 6,358,081 | B1 * | 3/2002 | Saka et al. | 439/352 |
| 6,368,140 | B2 * | 4/2002 | Torii | 439/352 |
| 6,386,898 | B1 * | 5/2002 | Taguchi | 439/352 |
| 6,475,014 | B2 * | 11/2002 | Tsuji et al. | 439/352 |
| 6,494,732 | B2 * | 12/2002 | Kashiyama et al. | 439/352 |
| 6,497,585 | B2 * | 12/2002 | Toril | 439/352 |

* cited by examiner

*Primary Examiner*—Gary Paumen

(57) ABSTRACT

An electrical connector assembly is provided. The electrical connector assembly includes a stationary arm on a first connector to which a moveable latch on a second connector is locked and unlocked. The first connector includes a release arm for lifting the moveable latch from the stationary arm. A driving member on the first connector drives the release arm from first to second positions, causing the release arm to lift the moveable latch. A first spring returns the release arm to the first position, while a second spring returns the moveable latch downward after it has been lifted. The release arm may be flexible, slidable, or rotatable between the first and second positions.

16 Claims, 15 Drawing Sheets

HMZD CABLE CONNECTOR LATCH ASSEMBLY

BACKGROUND OF THE INVENTION

Certain embodiments of the present invention generally relate to an electrical connector assembly having a header connector mateable with a receptacle connector, and more particularly, to apparatus for fastening and unfastening cable connectors to and from one another.

Electrical connectors typically are arranged to be connected to complimentary connector halves to form connector pairs. It is well known to use mechanical latching mechanisms for maintaining the connection between connector halves. Typically, latching mechanisms include a projection on a first connector half that extends therefrom in a direction transverse to a mating direction along which the first connector half and a second connector half are mated. The second connector half typically includes a notch or hole for receiving the projection on the first connector half, or includes a wall or another projection for engaging with the projection on the first connector half. It is further well known to use mechanical latch-releasing mechanisms for disengaging the latching mechanisms between the connector halves in order to facilitate unmating of the connector halves. Typically, latch-releasing mechanisms include a driving member, to be activated by a user, that causes the projection on the first connector half to move, thereby disengaging the projection from a notch, hole, wall, or projection on the second connector half.

One of the problems with conventional latch-releasing mechanisms is that access to the mated connectors is needed in order to release the latching mechanism to unmate the connectors. Some connectors employ latch-releasing mechanisms that are disposed on opposite sides of the connectors. These latch-releasing mechanisms require pinching or squeezing on opposite sides of the connectors to release a locking mechanism such as a latch. Consequently, these connectors require access to the connectors from both sides thereof in order to release the latching mechanism.

In one conventional latch-releasing mechanism, a connector has latches on opposite sides thereof and a U-shaped latch-releasing mechanism, accessible from the top of the connector. The latch-releasing mechanism can be pushed downward, causing the latches on the sides to release. Hence, the latch-releasing mechanism requires access only to the top of the connector and not to the sides of the connector. The latches on the sides and the latch-releasing mechanism on top, however, thereby increase both the connector's width and height.

Other conventional latch-releasing mechanisms are designed so that access to the latch-releasing mechanisms, such as by hand or a tool, is unnecessary. Typically, connectors have ramped or chamfered surfaces for forcing locking means to flex or compact during mating and unmating of connector halves. Thus, the connector halves are simply pushed on to, and pulled off from, complimentary connector halves. Mating and unmating by the sheer application of force can damage the connector housings and the precisely arranged contacts within the housings as well as the connections between the connectors and printed circuit boards (PCBs).

An example of an environment wherein access to a pair of mated connector halves is very limited, is in the field of telecommunications cables. For example, several cable connectors may be required to fit into a small box that also houses a back plane PCB and several daughter PCBs. Often the daughter PCBs may be arranged parallel to one another and only separated from one another by a small distance such as one inch. It may be required that the cable connectors be mounted to the daughter PCBs and positioned in the small distances between the daughter PCBs. The cable connectors may also be mounted side by side with one another in very close proximity or even abutting one another.

A need remains for a cable connector system that provides easier unmating of cable connectors under space constraints.

BRIEF SUMMARY OF THE INVENTION

An embodiment of the present invention provides a cable connector assembly with a locking mechanism. The locking mechanism includes a stationary arm on a first connector to which a moveable latch on a second connector is locked and unlocked. The first connector includes a moveable arm, or a plurality of moveable arms, for lifting the moveable latch on the second connector to disengage the stationary arm on the first connector. A driving member on the first connector drives the moveable arm from first to second positions, causing the moveable arm to lift the moveable latch. A first spring returns the moveable arm to the first position, while a second spring biases the moveable latch downward to return the moveable latch to a resting position after the moveable latch has been lifted.

Optionally, the moveable arm may be modified to offer flexible, slidable, or liftable motion. The moveable arm may have a chamfered or ramped surface that engages a complimentary ramped surface on the connector housing, thereby forcing the flexible arm to flex. The moveable arm may have a chamfered or ramped surface that engages and lifts the moveable latch directly. The moveable arm may constitute an end of a lever that lifts the moveable latch. Optionally, the driving member may be configured to be slidable toward or away from the moveable latch, or, alternatively, it may be configured to be rotatable about an axis.

Figure 1:
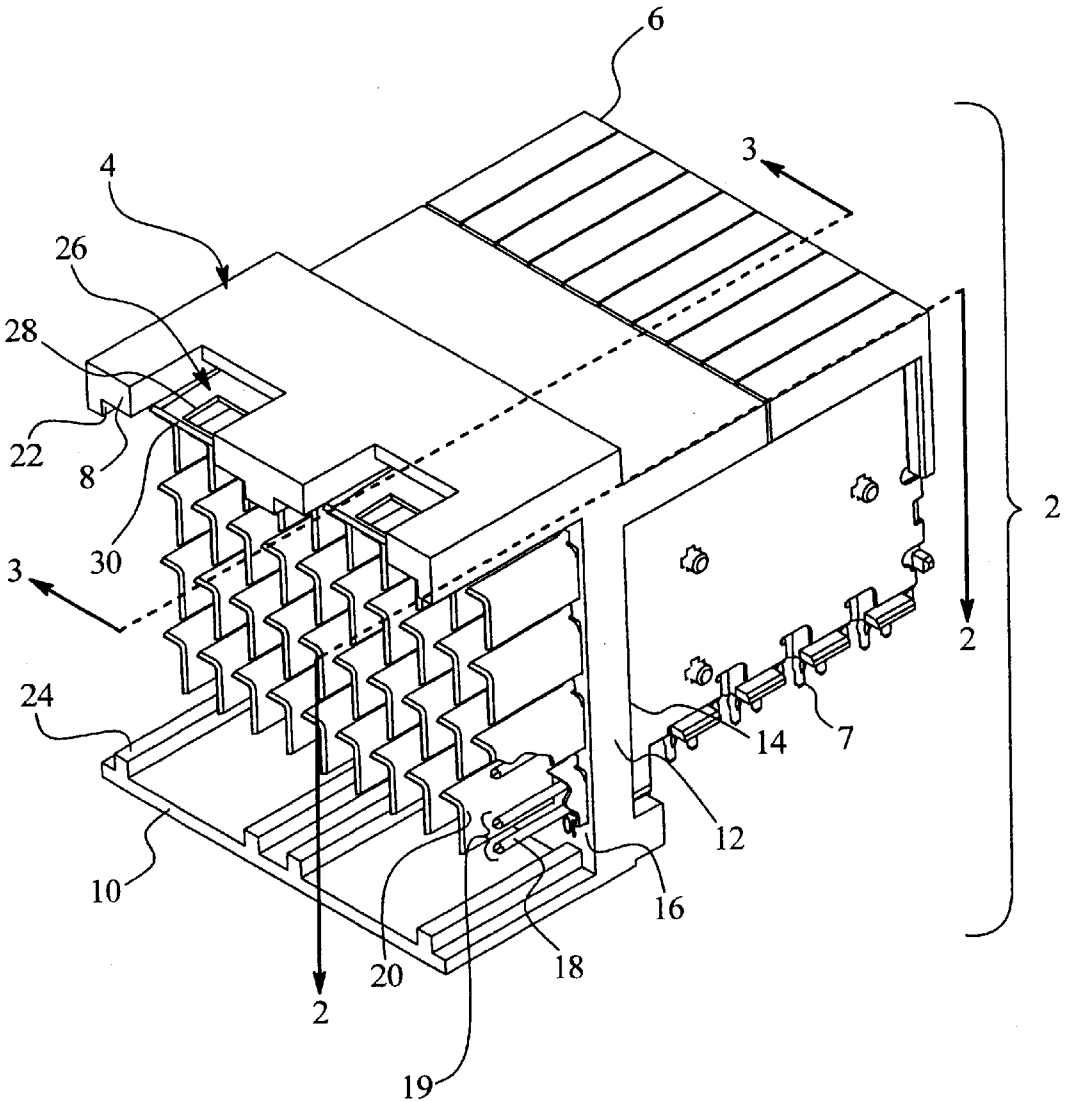
FIG. 1 illustrates a top rear perspective view of a header assembly formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 4:
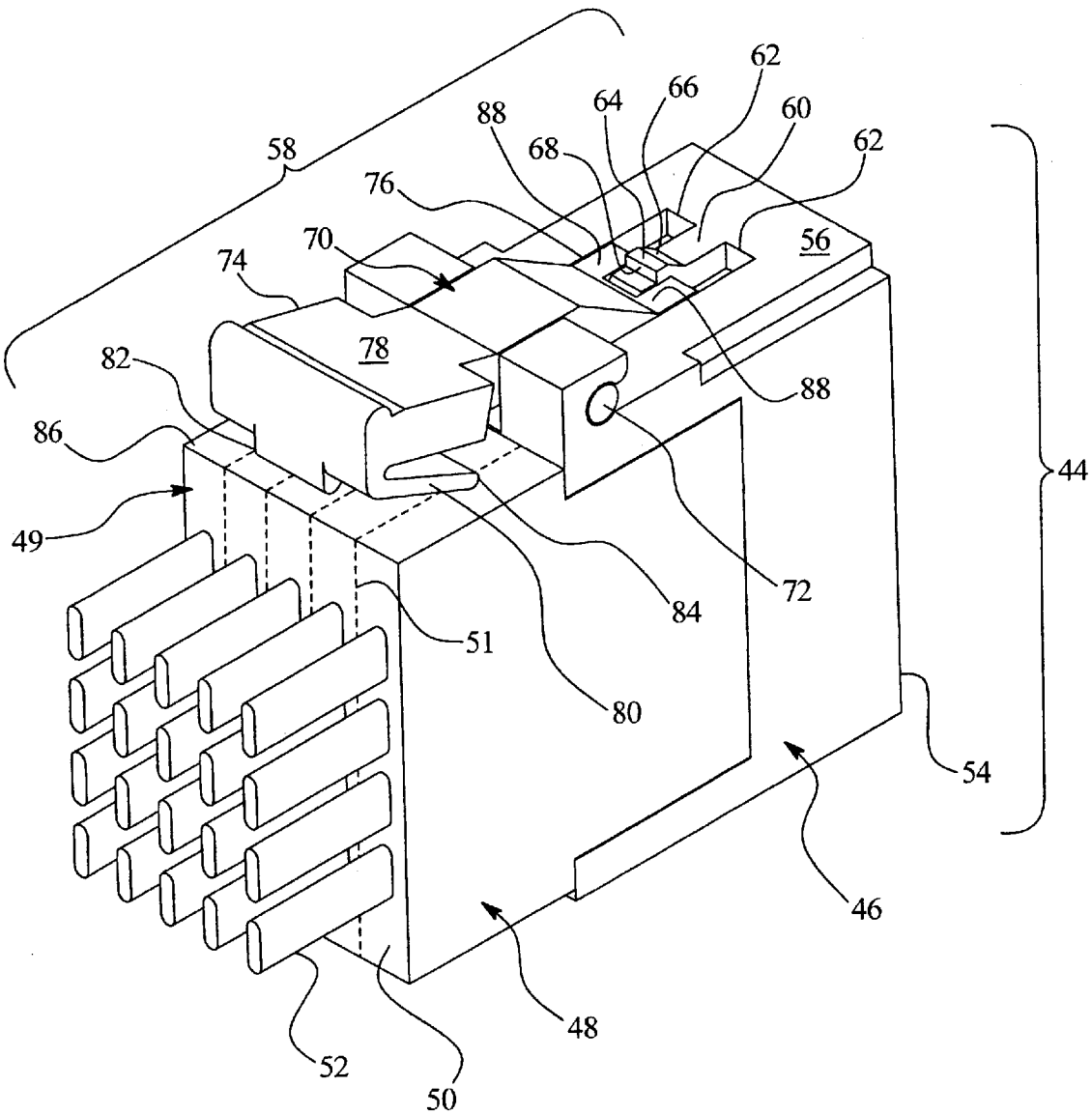
FIG. 4 illustrates a top rear perspective view of a receptacle assembly formed in accordance with an embodiment of the present invention.
Figure 6:
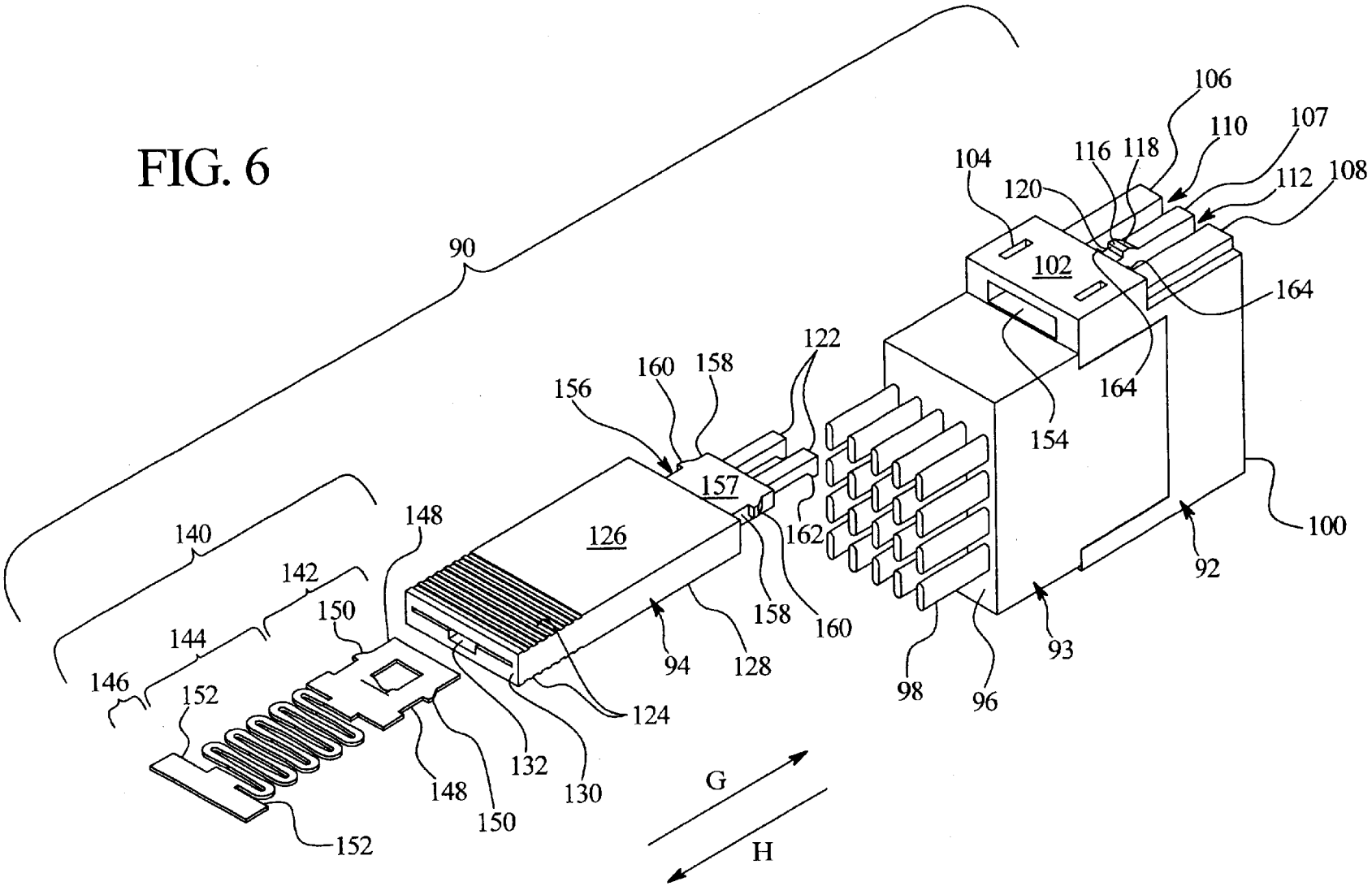
FIG. 6 illustrates an exploded view of a receptacle assembly formed in accordance with an alternative embodiment of the present invention.
Figure 11:
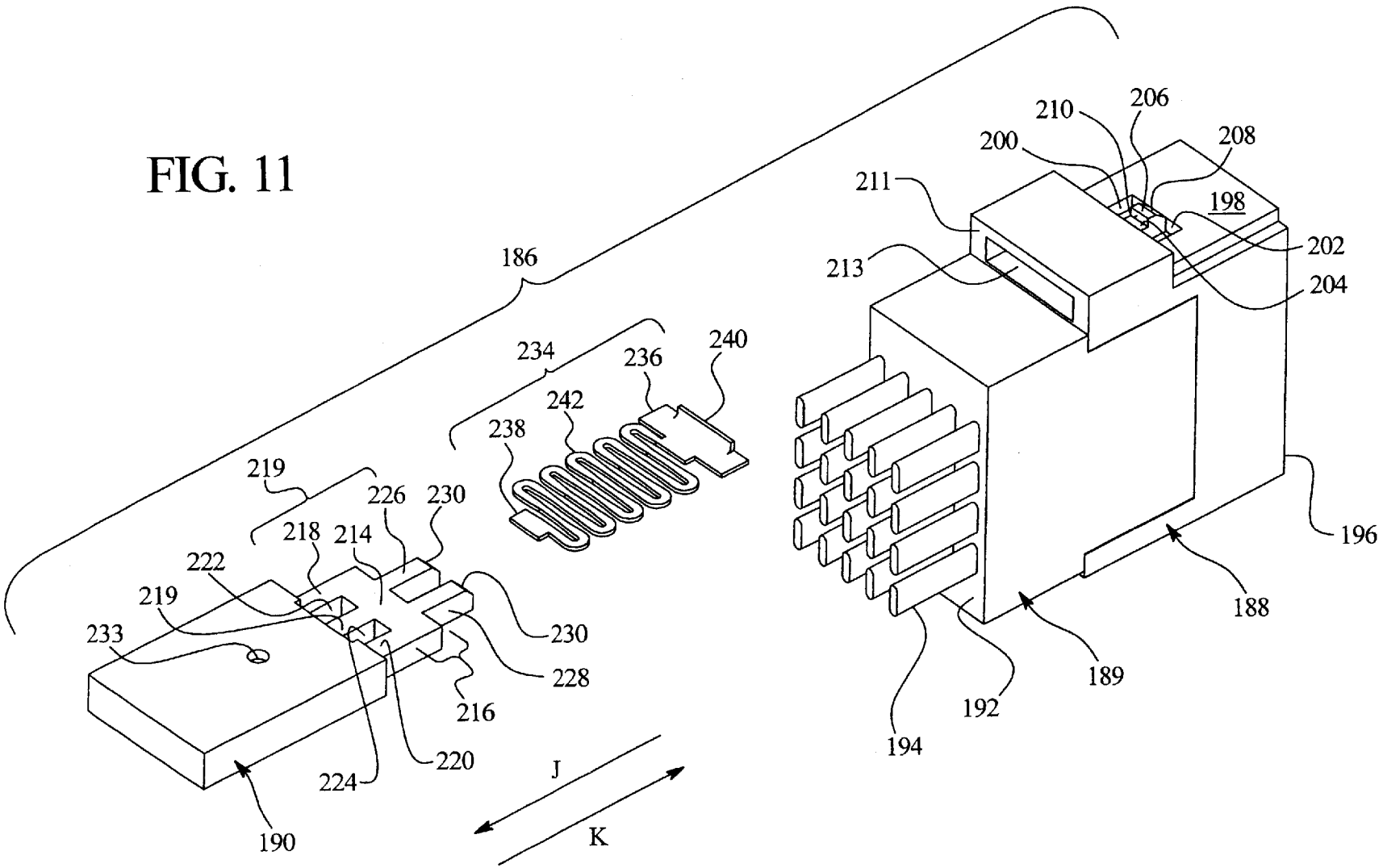
FIG. 11 illustrates an exploded view of a receptacle assembly formed in accordance with an alternative embodiment of the present invention.

FIG. 1 illustrates a right angle header assembly 2 formed in accordance with an embodiment of the present invention. The header assembly 2 includes a header housing 4 holding a plurality of signal modules 6 therein. The signal modules 6 are aligned adjacent to one another. The signal modules 6 include pins 7 for mating with vias on a back plane PCB (not shown). The header housing 4 includes top and bottom walls 8 and 10, respectively, that are aligned parallel to, and spaced apart from, one another by a main wall 12. The main wall 12 includes a signal module-mating surface 14 and a receptacle assembly-mating surface 16 opposite one another. The signal modules 6 are joined with the header housing 4 along the signal module-mating surface 14. The signal modules 6 include signal pins 18 arranged in differential pairs 19 and L-shaped ground shields 20 protruding through the main wall 12 and extending beyond the receptacle assembly-mating surface 16 for mating with receptacle assemblies 44, 90, and 186 (FIGS. 4, 6, and 11). Two of the ground shields 20 are partially cut away to reveal the signal pins 18.

The receptacle assembly-mating surface 16 and the top and bottom walls 8 and 10 define a space for receiving receptacle assemblies 44, 90, and 186. The top and bottom walls 8 and 10 include edges 22 and rails 24, respectively, for guiding the receptacle assemblies 44, 90, and 186 onto the header assembly 2 during mating. The main wall 12 includes a cantilever latch 26 proximate the top wall 8. The cantilever latch 26 is formed from metal or another flexible material. The cantilever latch 26 includes a square window 28 for locking with a mated receptacle assembly 44, 90, and 186. A rear edge 30 of the cantilever latch 26 is curved upward away from the bottom wall 10.

Figure 2:
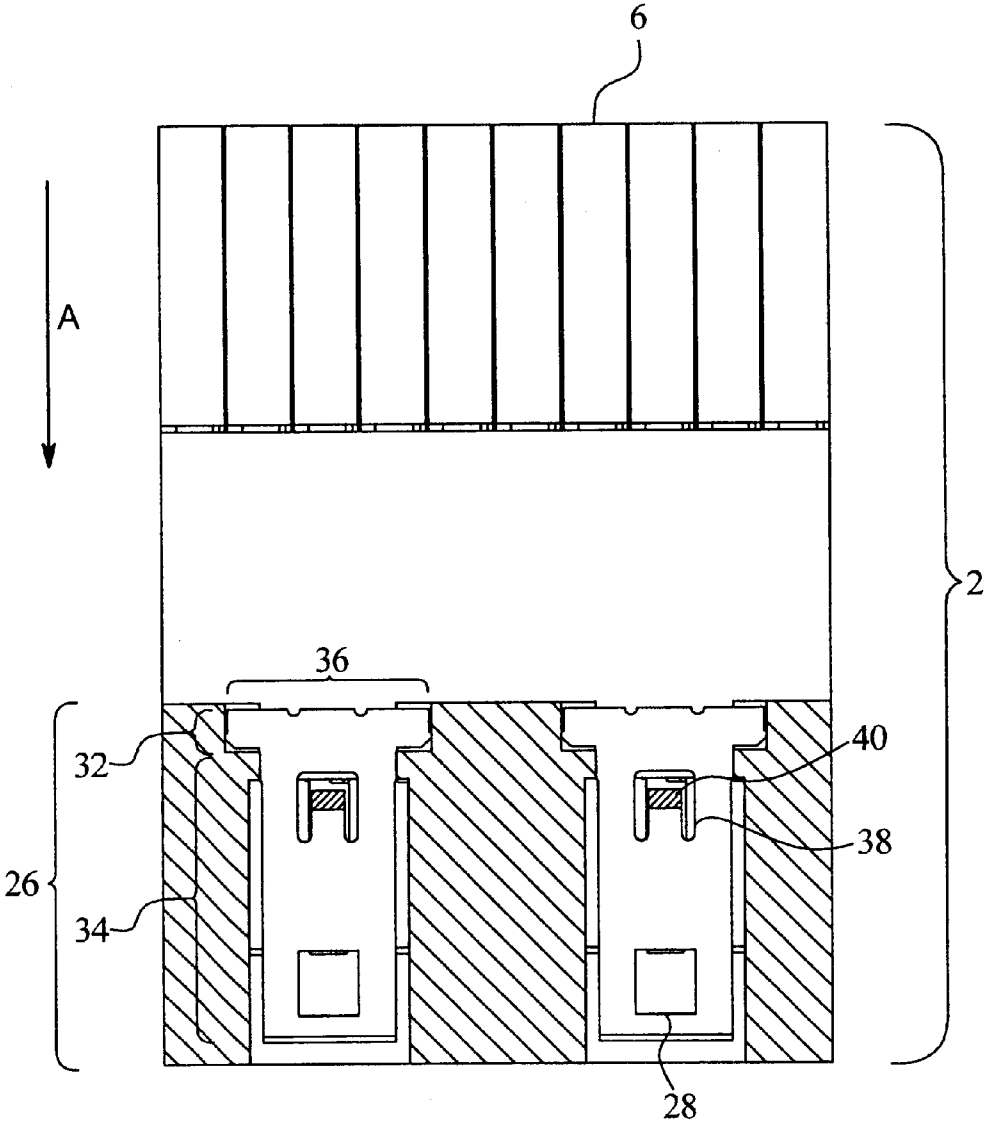
FIG. 2 illustrates a cross sectional view of the header assembly taken along line 2—2 in FIG. 1.

FIG. 2 illustrates a cross-sectional view of the header assembly 2 taken along line 2—2 in FIG. 1. Each cantilever latch 26 includes a mounting blade 32 and a flexible body section 34. The mounting blade 32 is flat and generally rectangular in shape. The mounting blade 32 is secured in a slot 36 formed in the main wall 12. The flexible body section 34 is generally flat and rectangular in shape. The flexible body section 34 includes square cutout 38 and the square window 28. The square cutout 38 includes a cantilever tab 40. The cantilever latch 26 is loaded into the header assembly 2 in the direction of arrow A until the mounting blade 32 occupies the slot 36.

Figure 3:
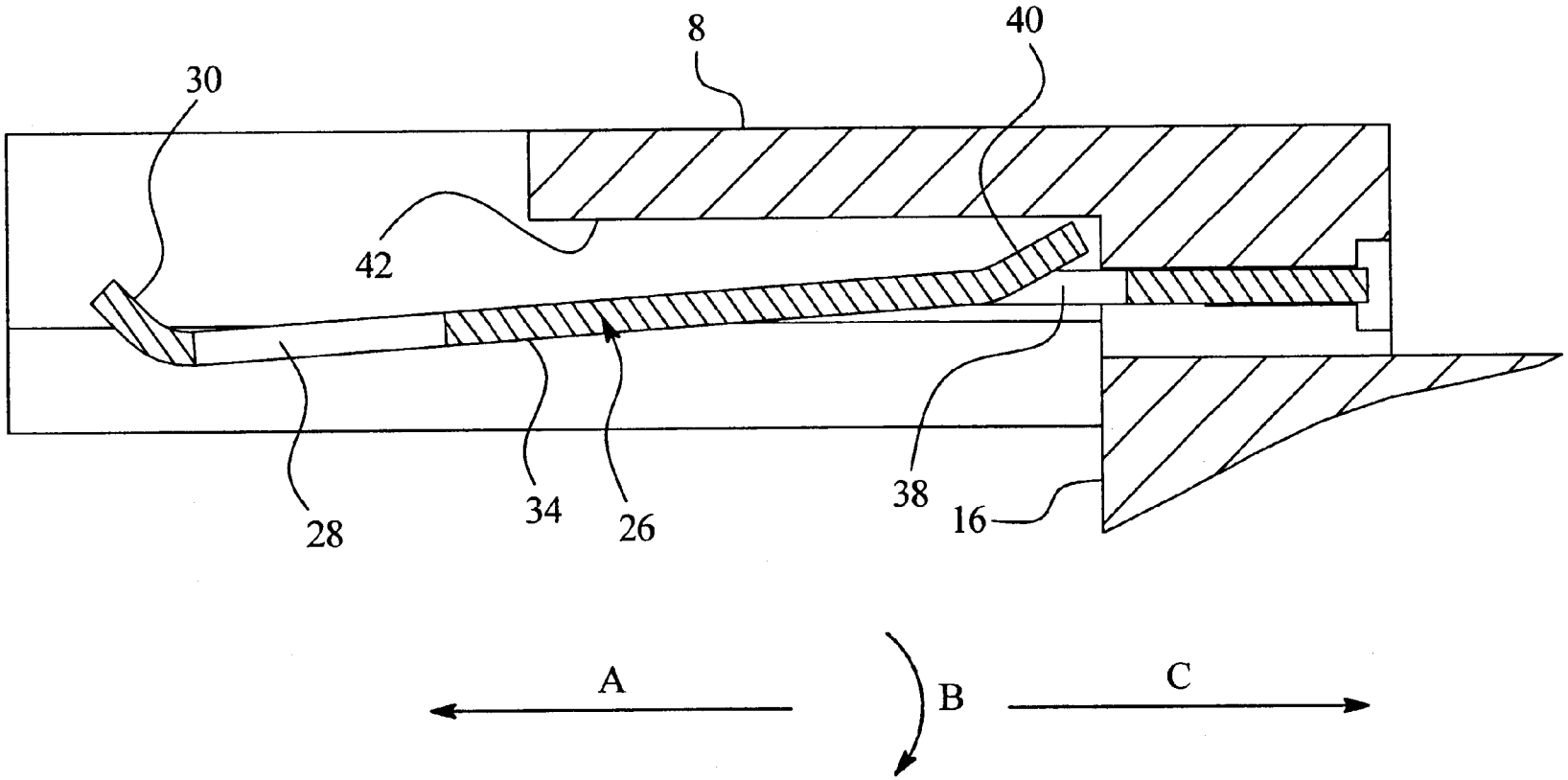
FIG. 3 illustrates a cross sectional view of the header assembly taken along line 3—3 in FIG. 1.

FIG. 3 illustrates a cross sectional view of a portion of the header assembly 2 taken along line 3—3 in FIG. 1. The cantilever tab 40 of the cantilever latch 26 extends upward at an angle from the plane of the flexible body section 34 and toward a bottom surface 42 of the top wall 8. As the cantilever latch 26 is loaded into the header assembly 2 in the direction of arrow A, the cantilever tab 40 is deflected rotatably downward in the direction of arrow B and into the square cutout 38. Once the cantilever tab 40 exits the slot 36, the cantilever tab 40 biases rotatably upward to a locked position (shown in FIG. 3). Thus, the cantilever latch 26 may not move in the direction of arrow C because the cantilever tab 40 now engages the receptacle assembly-mating surface 16.

FIG. 4 illustrates a receptacle assembly 44 for mating with the header assembly 2 formed in accordance with an embodiment of the present invention. The receptacle assembly 44 includes front and rear housings 46 and 48. The rear housing 48 optionally may comprise a plurality of signal modules 49, which are illustrated by dashed lines 51 only in the example of FIG. 4. The rear housing 48 includes a rear surface 50 having a plurality of cables 52 extending therefrom. In the example of FIG. 4, each cable 52 corresponds to two pins 18 and one ground shield 20 on the receptacle assembly-mating surface 16 of the header assembly 2. The front housing 46 includes a header assembly-mating surface 54 opposite the rear surface 50 for mating with the header assembly 2. A top surface 56 of the front housing 46 includes a locking arm 60 straddled on both sides by channels 62. The locking arm 60 includes an upwardly projecting tooth 64 that has a front ramped surface 66 and a rear walled surface 68. The top surface 56 also includes a latching member 58 for locking and unlocking with the cantilever latch 26 of the header assembly 2.

The latching member 58 includes a lever 70 rotatable about a pin 72. The lever 70 includes an actuating end 74 and a working end 76. The actuating end 74 includes a push surface 78. Opposite the push surface 78, the actuating end 74 includes a spring beam 80 and a stop rib 82. A free end 84 of the spring beam 80 contacts a top surface 86 of the rear housing 48. The working end 76 of the lever 70 includes a pair of forked fingers 88 that partially occupy the channels 62 for lifting the cantilever latch 26 on the header assembly 2.

Figure 5:
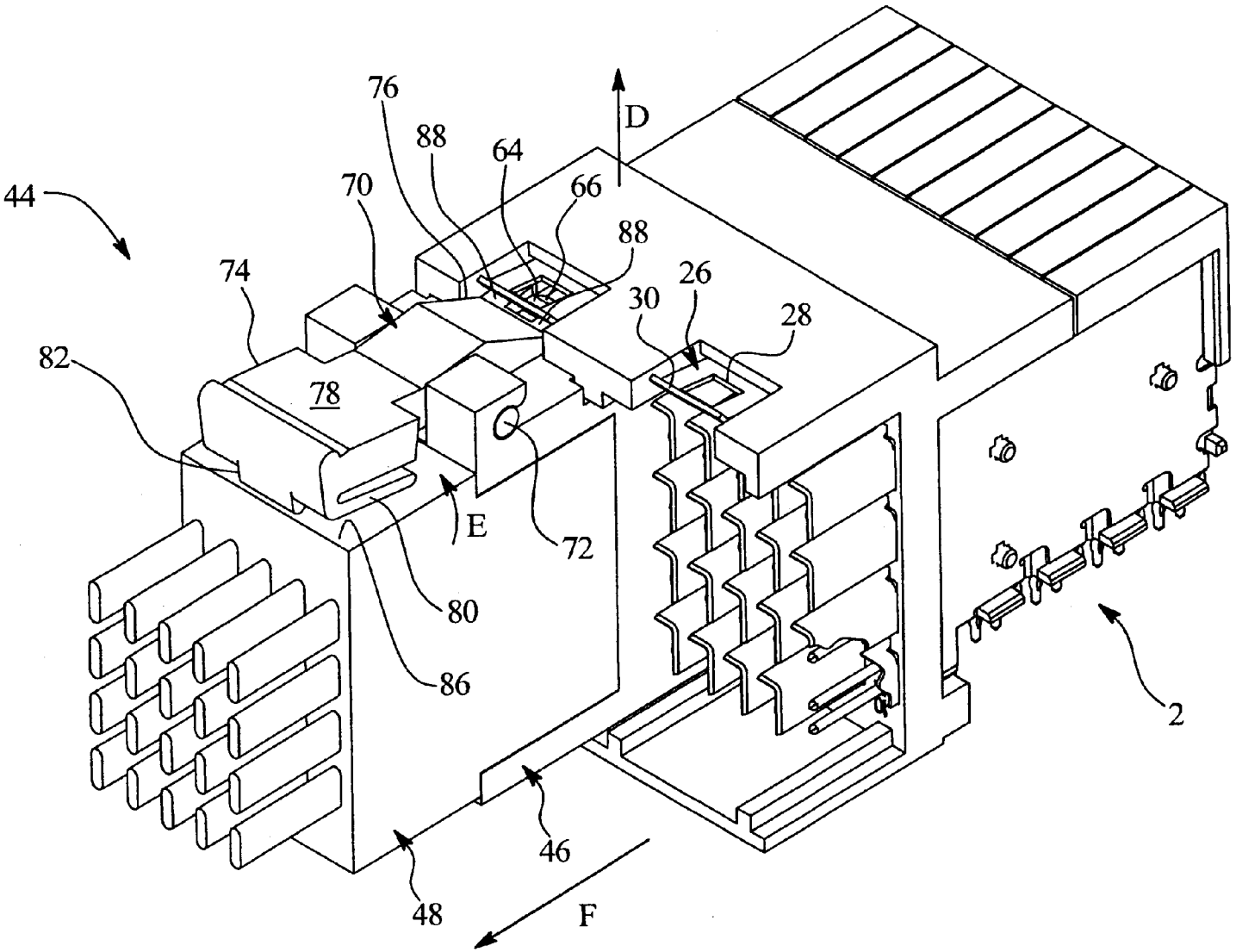
FIG. 5 illustrates a top rear perspective view of receptacle and header assemblies mated, but not locked, to one another.

FIG. 5 illustrates the header assembly 2 mated with, but not locked to, the receptacle assembly 44. In the example of FIG. 5, the header assembly 2 is capable of mating with two receptacle assemblies 44, but only one receptacle assembly 44 is shown. When the receptacle assembly 44 is mated with the header assembly 2, the front ramped surface 66 of the tooth 64 engages and lifts the upwardly curved rear edge 30 of the cantilever latch 26 in the direction of arrow D, allowing the tooth 64 to pass under the cantilever latch 26. When the tooth 64 reaches the square window 28, the cantilever latch 26 recoils downward to a locked position (shown in FIG. 1). In the locked position, the tooth 64 projects upward through the square window 28 of the cantilever latch 26. Unmating of the receptacle assembly 44 from the header assembly 2 is prohibited by interaction of the rear walled surface 68 of the tooth 64 and the square window 28.

When a user presses down on the pushing surface 78, the spring beam 80 is bent in the direction of arrow E, and the actuating end 74 moves downward until the stop rib 82 abuts the top surface 86 of the rear housing 48. Downward movement of the actuating end 74 causes the lever 70 to rotate about the pin 72, thereby lifting the working end 76 in the direction of arrow D. As the working end 76 rises, the forked fingers 88 lift the cantilever latch 26 until the cantilever latch 26 clears the tooth 64. Hence, the receptacle assembly 44 can be pulled free, in the direction of arrow F, from the header assembly 2 because the rear walled surface 68 of the tooth 64 no longer engages the square window 28. Once the user ceases pressing downward on the pushing surface 78, the spring beam 80 on the actuating end 74 biases the lever 70 to recoil to the rest position.

FIG. 6 illustrates an exploded view of a receptacle assembly 90 for mating with the header assembly 2 formed in accordance with an alternative embodiment of the present invention. The receptacle assembly 90 includes front, rear, and pull housings 92–94. The rear housing 93 includes a rear surface 96 having a plurality of cables 98 extending therefrom. In the example of FIG. 6, each cable 98 corresponds to two pins 18 and one ground shield 20 on the receptacle assembly-mating surface 16 of the header assembly 2.

The front housing 92 includes a header assembly-mating surface 100 opposite the rear surface 96 for mating with the header assembly 2. The front housing 92 includes a top surface 102 having rectangular windows 104 for manufacturing purposes formed therein. The front housing 92 includes rails 106–108 separated from one another by channels 110 and 112. A center rail 107 includes an upwardly projecting tooth 116. The tooth 116 has a front ramped surface 118 and a rear walled surface 120.

The pull housing 94 includes flexible arms 122 that extend through the front housing 92 and slidably rest in, and partially occupy, the channels 110 and 112. The flexible arms 122 are positioned on either side of the center rail 107. The pull housing 94 includes ribbed pull surfaces 124 along top and bottom surfaces 126 and 128 of the pull housing 94. The pull housing 94 also includes a rear surface 130 having a spring-loading chamber 132 formed therein.

The spring-loading chamber 132 in the rear end of the pull housing 94 receives a spring 140 that is inserted in the direction of arrow G. The spring 140 includes a front section 142, a coil 144, and a rear section 146. The front section 142 is generally square in shape and includes side edges 148 having triangular projections 150 extending outward therefrom. The triangular projections 150 allow loading of the front section 142 into the front housing 92 in the direction of arrow G, and, thereafter, prevent rearward movement of the front section 142 in the direction of arrow H. The coil 144 connects the front section 142 to the rear section 146, and is extendable in length so as to allow the front and rear sections 142 and 146 to move relative to one another. In FIG. 6, the coil 144 is shown in its resting state. The rear section 146 is rectangular in shape and has leading edges 152.

Figure 8:
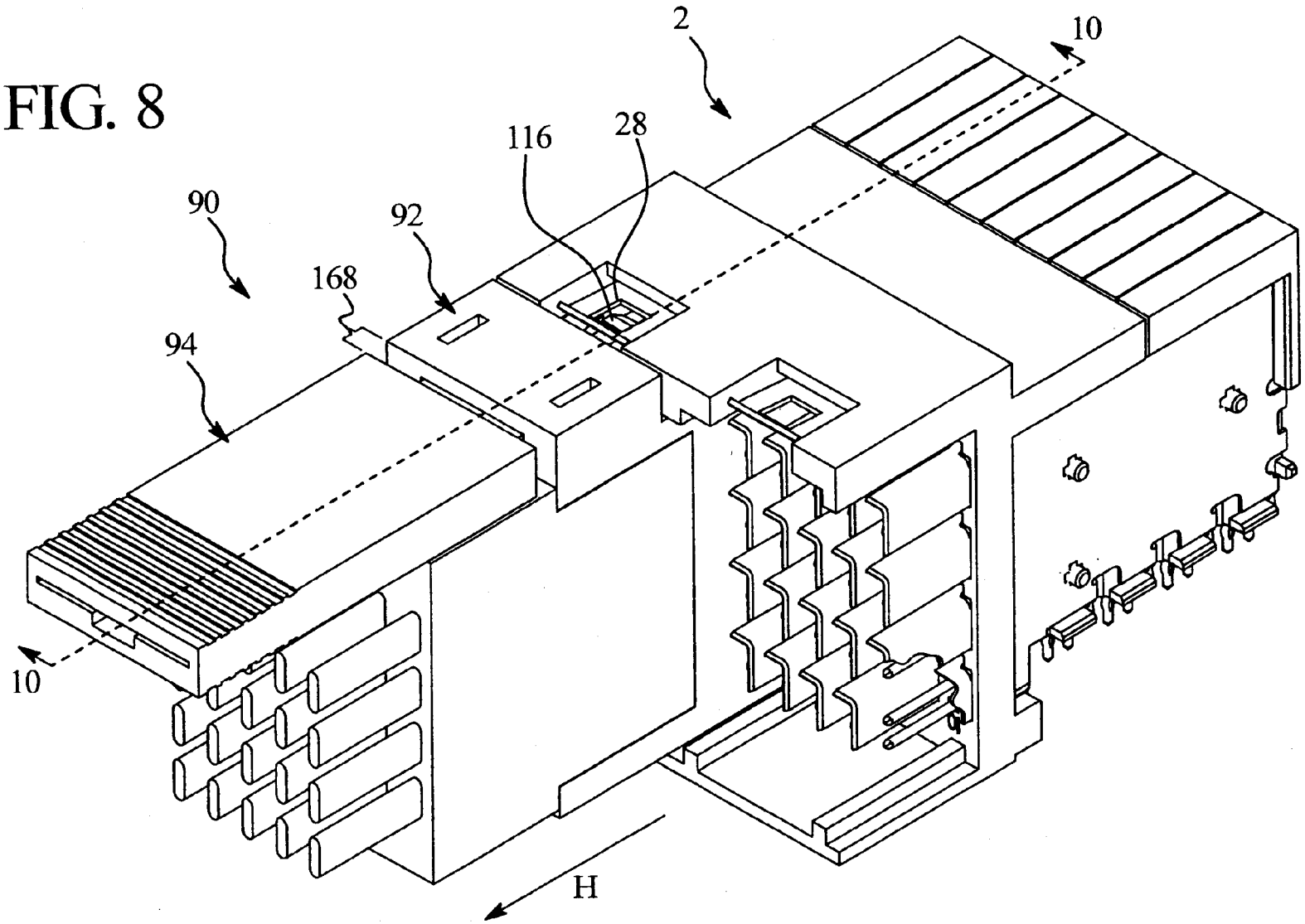
FIG. 8 illustrates a top rear perspective view of the receptacle and header assemblies of FIG. 7 mated, but not locked, to one another.
Figure 9:
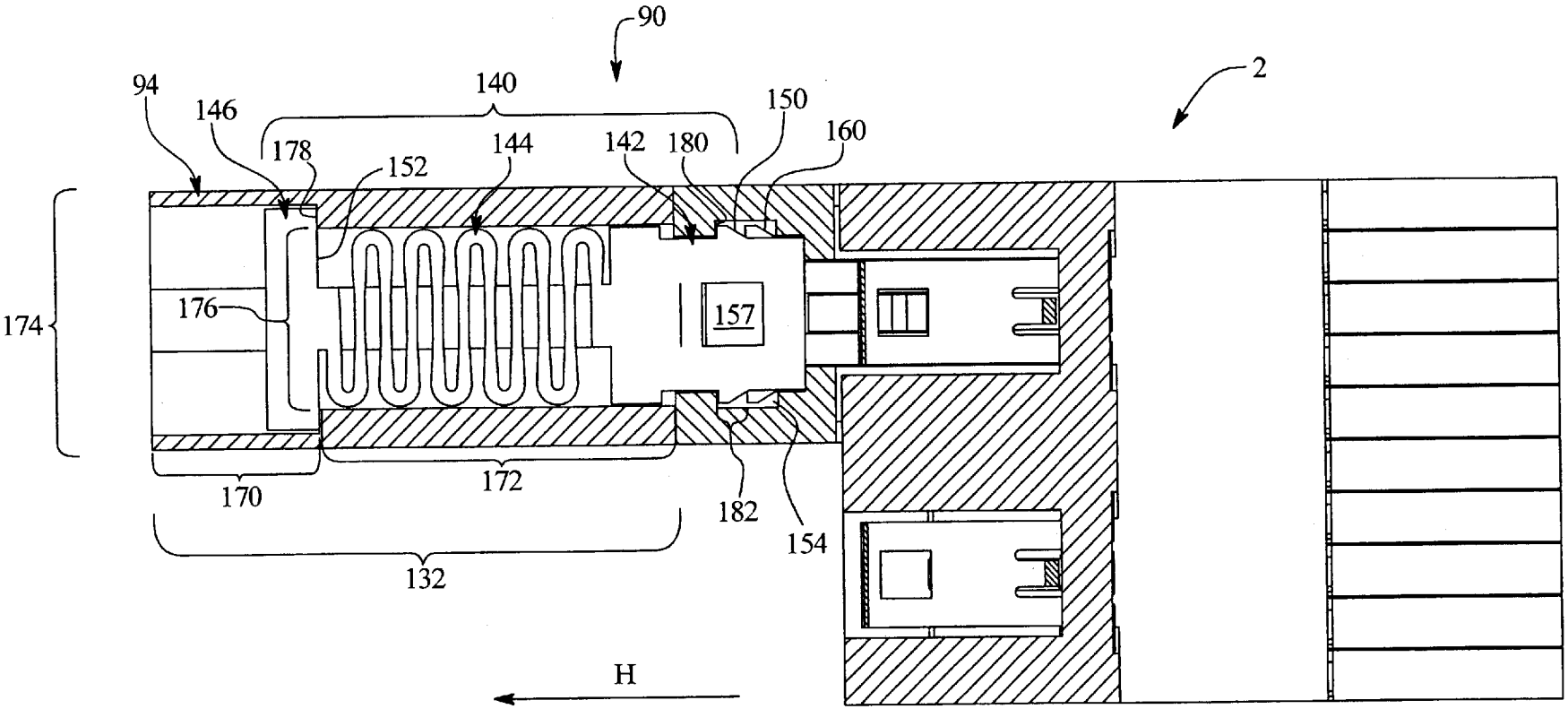
FIG. 9 illustrates a cross sectional view of the receptacle and header assemblies taken along line 9—9 in FIG. 7.

The pull housing 94 is loaded in the direction of arrow G into a rectangular chamber 154 in the rear end of the front housing 92. The pull housing 94 includes a rectangular mating portion 156 that is inserted into the chamber 154. The mating portion 156 includes a top surface 157 and includes sides 158 having triangular projections 160 extending therefrom. The triangular projections 160 allow loading of the mating portion 156 into the front housing 92 in the direction of arrow G and prevent removal of the mating portion 156 from the chamber 154 in the direction of arrow H beyond a predetermined action distance 182 (FIG. 9). The action distance 182 defines an operating range for the pull housing 94. As explained below, when the pull housing 94 is pulled by a user rearward through the action distance 182, the pull housing 94 releases the receptacle assembly 90 from the header assembly 2 (FIG. 8). The flexible arms 122, which extend from the front of the mating portion 156, include downwardly projecting ramps 162 for engaging upwardly projecting ramps 164 (more easily seen in FIG. 10) on the front housing 92.

Figure 7:
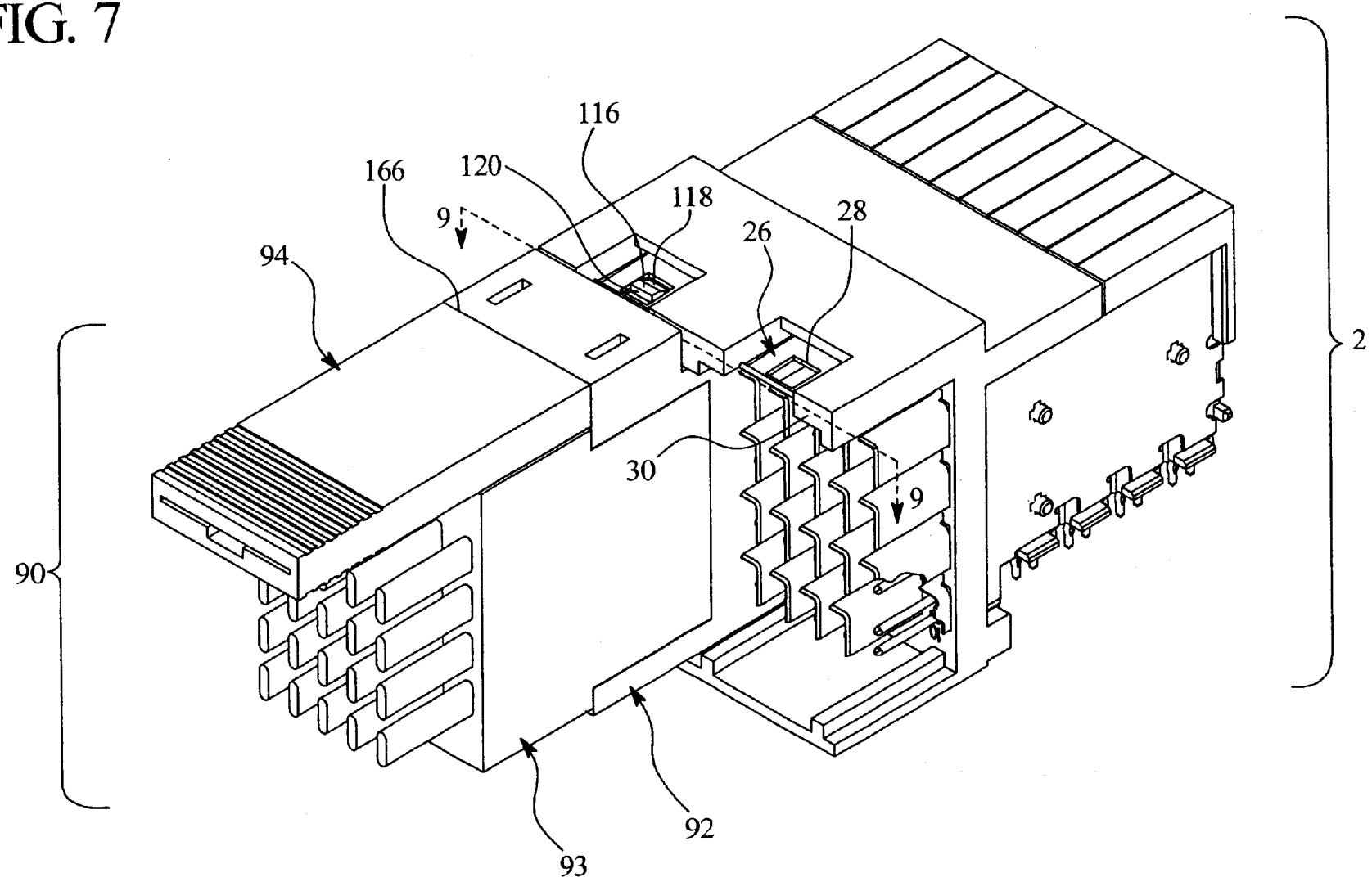
FIG. 7 illustrates a top rear perspective view of a receptacle assembly mated, and locked, with a header assembly formed in accordance with an embodiment of the present invention.

FIG. 7 illustrates the receptacle assembly 90 mated with, and locked to, the header assembly 2. In the example of FIG. 7, the header assembly 2 is capable of mating with two receptacle assemblies 90, but only one receptacle assembly 90 is shown. During mating of the receptacle assembly 90 to the header assembly 2, the front ramped surface 118 of the tooth 116 engages and lifts the upwardly curved rear edge 30 of the cantilever latch 26, allowing the tooth 116 to pass under the cantilever latch 26. When the tooth 116 reaches the square window 28, the cantilever latch 26 recoils downward to a locked position (shown in FIG. 7). In the locked position, the tooth 116 projects upward through the square window 28 of the cantilever latch 26. When in the locked position, the front and pull housings 92 and 94 abut one another at interface 166. Unmating of the receptacle assembly 90 from the header assembly 2 is prevented since the rear walled surface 120 of the tooth 116 is held within the square window 28.

FIG. 8 illustrates the header assembly 2 mated with the receptacle assembly 90, but with the pull housing 94 pulled in the direction of arrow H. A rearward force applied by the user to the pull housing 94 in the direction of arrow H causes the front and pull housings 92 and 94 to become separated by a gap 168. When the pull housing 94 is located as shown in FIG. 8, the receptacle assembly 90 can be pulled free, in the direction of arrow H, from the header assembly 2 because the rear walled surface 120 of the tooth 116 no longer engages the square window 28.

FIG. 9 illustrates a cross-sectional view of the header assembly 2 mated with the receptacle assembly 90 taken along line 9—9 in FIG. 7. The spring-loading chamber 132 includes rectangular sub-chambers 170 and 172. The sub-chamber 170 has a width 174 that is greater than a width 176 of the sub-chamber 172. The width 176 of the sub-chamber 172 is great enough to allow the loading of the front section 142 and the coil 144, but not the rear section 146, of the spring 140. Thus, the spring 140 is loaded into the spring-loading chamber 132 until the leading edges 152 of the rear section 146 abut walls 178 at the rear of the sub-chamber 172.

The front section 142 of the spring 140 and the mating portion 156 of the pull housing 94 extend into the chamber 154. The front section 142 lies on the top surface 157 of the mating portion 156. The chamber 154 includes rear walls 180 for engaging the triangular projections 150 and 160. The triangular projections 150 prevent the front section 142 of the spring 140 from moving in the direction of arrow H. The triangular projections 160 prevent the pull housing 94 from moving more than the distance 182 in the direction of arrow H.

Figure 10:
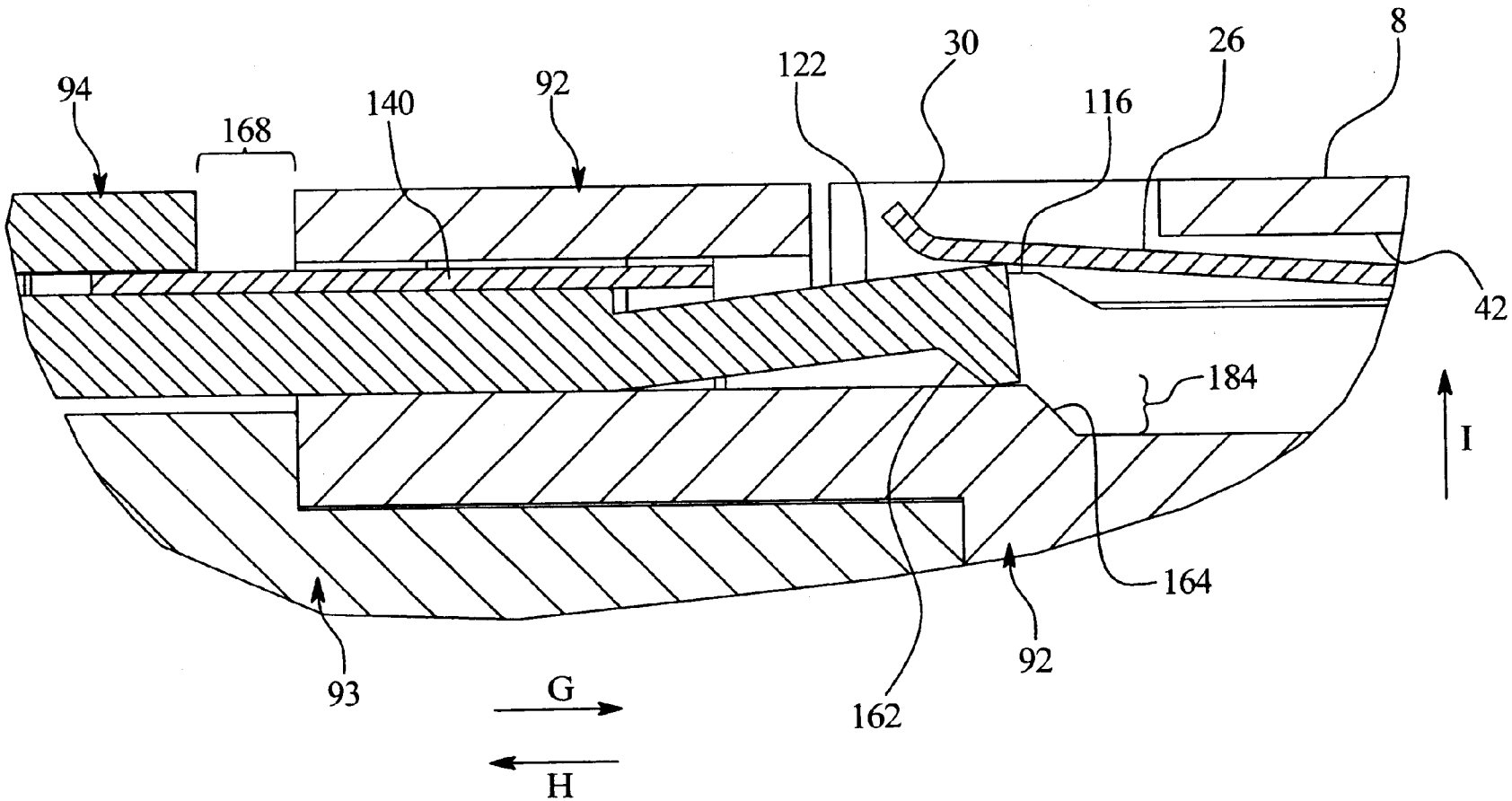
FIG. 10 illustrates a cross sectional view of portions of the receptacle and header assemblies taken along line 10—10 in FIG. 8.

FIG. 10 illustrates a detailed cross-sectional view of the flexible arms 122 lifting the cantilever latch 26 taken along line 10—10 in FIG. 8. The flexible arms 122 are flexed upward a distance 184, thereby lifting the cantilever latch 26 over the tooth 116 and unlocking the receptacle assembly 90 from the header assembly 2.

As the pull housing 94 moves rearward in the direction of arrow H, the pull housing 94 pulls the flexible arms 122 rearward. Consequently, the ramps 162 on the flexible arms 122 slide rearward across the ramps 164 on the front housing 92, causing the flexible arms 122 to flex upward in the direction of arrow I. As the flexible arms 122 flex upward, the flexible arms 122 lift the cantilever latch 26 above the tooth 116. While the pull housing 94 pulls the flexible arms 122 rearward, the pull housing 94 also pulls the rear section 146 of the spring 140 rearward, thereby elongating the coil 144. Once the rearward force on the pull housing 94 is removed, the coil 144 causes the pull housing 94 to recoil in the direction of arrow G to the locked position (shown in FIG. 7).

FIG. 11 illustrates an exploded view of a receptacle assembly 186 for mating with the header assembly 2 formed in accordance with an alternative embodiment of the present invention. The receptacle assembly 186 includes front, rear, and push housings 188–190. The rear housing 189 includes a rear surface 192 having a plurality of cables 194 extending therefrom. In the example of FIG. 11, each cable 194 corresponds to two pins 18 and one ground shield 20 on the receptacle assembly-mating surface 16 of the header assembly 2.

The front housing 188 includes a header assembly-mating surface 196 opposite the rear surface 192 for mating with the header assembly 2. The front housing 188 includes a top surface 198 having channels 200 and 202 formed therein. The channels 200 and 202 include a rail 204 therebetween. The rail 204 includes an upwardly projecting tooth 206. The tooth 206 has a front ramped surface 208 and a rear walled surface 210. The front housing 188 also includes a rear wall 211 having a rectangular chamber 213 formed therein.

The push housing 190 includes a mating portion 212 for mating with the front housing 188. The mating portion 212 includes a top surface 214 and a rectangular body section 216. The body section 216 includes beams 218–220 that connect the body section 216 to the remainder of the push housing 190. The beams 218–220 are separated from one another by channels 222 and 224. Opposite the beams 218–220, the body section 216 includes beams 226 and 228 extending therefrom. The beams 226 and 228 include chamfered ends 230 for lifting the cantilever latch 26 on the header assembly 2. The push housing 190 also includes a spring-loading chamber 232 (FIG. 14) formed therein and includes a circular hole 233 formed therethrough for manufacturing purposes.

The spring-loading chamber 232 opens on the front end of the push housing 190 and receives a spring 234 that is inserted in the direction of arrow J. The spring 234 includes rectangular front and rear tabs 236 and 238 for pushing off the front and push housings 188 and 190, respectively. The front tab 236 includes an upwardly projecting blade 240 for pushing against the rear wall 211 of the front housing 188. A coil 242 connects the front tab 236 to the rear tab 238, and is compressible in length so as to allow the front and rear tabs 236 and 238 to move relative to one another. In FIG. 11, the coil 242 is shown in its resting state. When loaded, the spring 234 partially rests on the top surface 214 of the mating portion 212. With the spring 234 loaded into the push housing 190, the push housing 190 is mated with the front housing 188. As the front and push housings 188 and 190 are mated, the mating portion 212 is loaded in the direction of arrow K into the chamber 213 formed in the rear wall 211 of the front housing 188.

Figure 12:
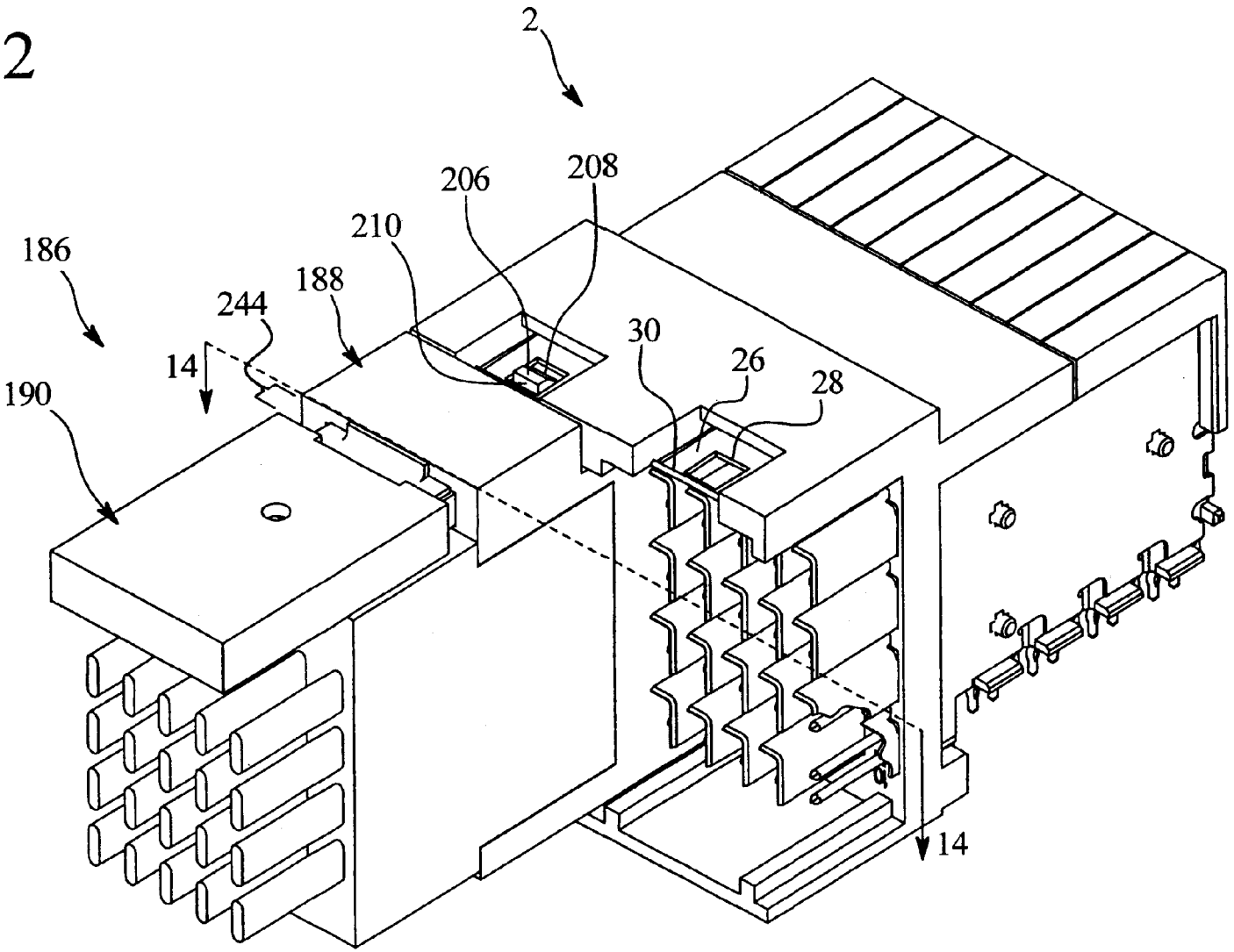
FIG. 12 illustrates a top rear perspective view of a receptacle assembly mated, and locked, with a header assembly formed in accordance with an embodiment of the present invention.

FIG. 12 illustrates the receptacle assembly 186 mated with, and locked to, the header assembly 2. In the example of FIG. 12, the header assembly 2 is capable of mating with two receptacle assemblies 186, but only one receptacle assembly 186 is shown. During mating of the receptacle assembly 186 to the header assembly 2, the front ramped surface 208 of the tooth 206 engages and lifts the upwardly curved rear edge 30 of the cantilever latch 26, allowing the tooth 206 to pass under the cantilever latch 26. When the tooth 206 reaches the square window 28, the cantilever latch 26 recoils downward to a locked position (shown in FIG. 12). In the locked position, the tooth 206 projects upward through the square window 28 of the cantilever latch 26. When in the locked position, the front and push housings 188 and 190 are separated from one another by a gap 244. Unmating of the receptacle assembly 186 from the header assembly 2 is prevented since the rear walled surface 210 of the tooth 206 is held within the square window 28.

Figure 13:
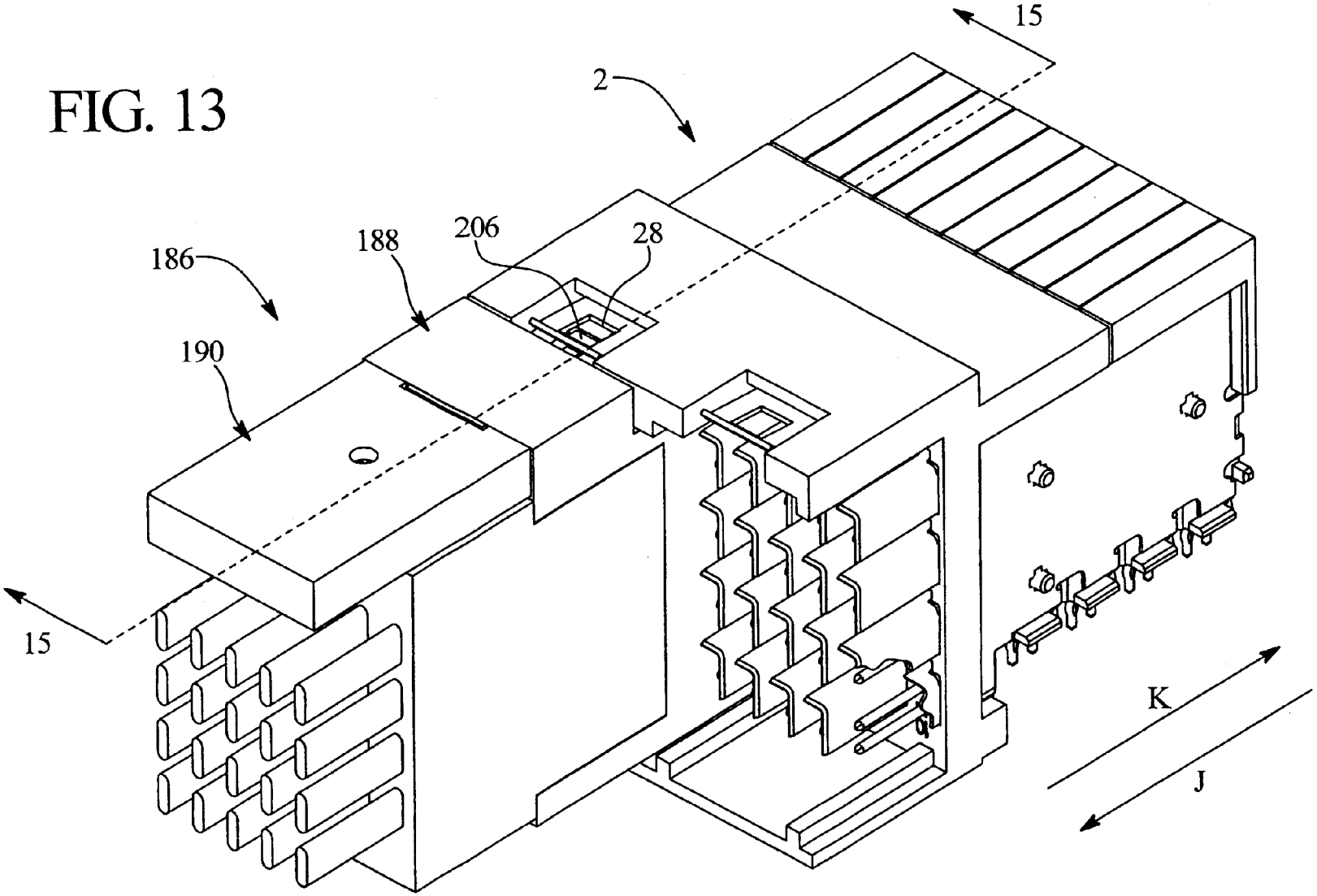
FIG. 13 illustrates a top rear perspective view of the receptacle and header assemblies of FIG. 12 mated, but not locked, to one another.

FIG. 13 illustrates the header assembly 2 mated with the receptacle assembly 186, but with the push housing 190 pushed in the direction of arrow K. A forward force applied by the user to the push housing 190 in the direction of arrow K causes the push housing 190 to move toward the front housing 188, thereby closing the gap 244. When the push housing 190 is located as shown in FIG. 13, the receptacle assembly 186 can be pulled free, in the direction of arrow J, from the header assembly 2 because the rear walled surface 210 of the tooth 206 no longer engages the square window 28.

Figure 14:
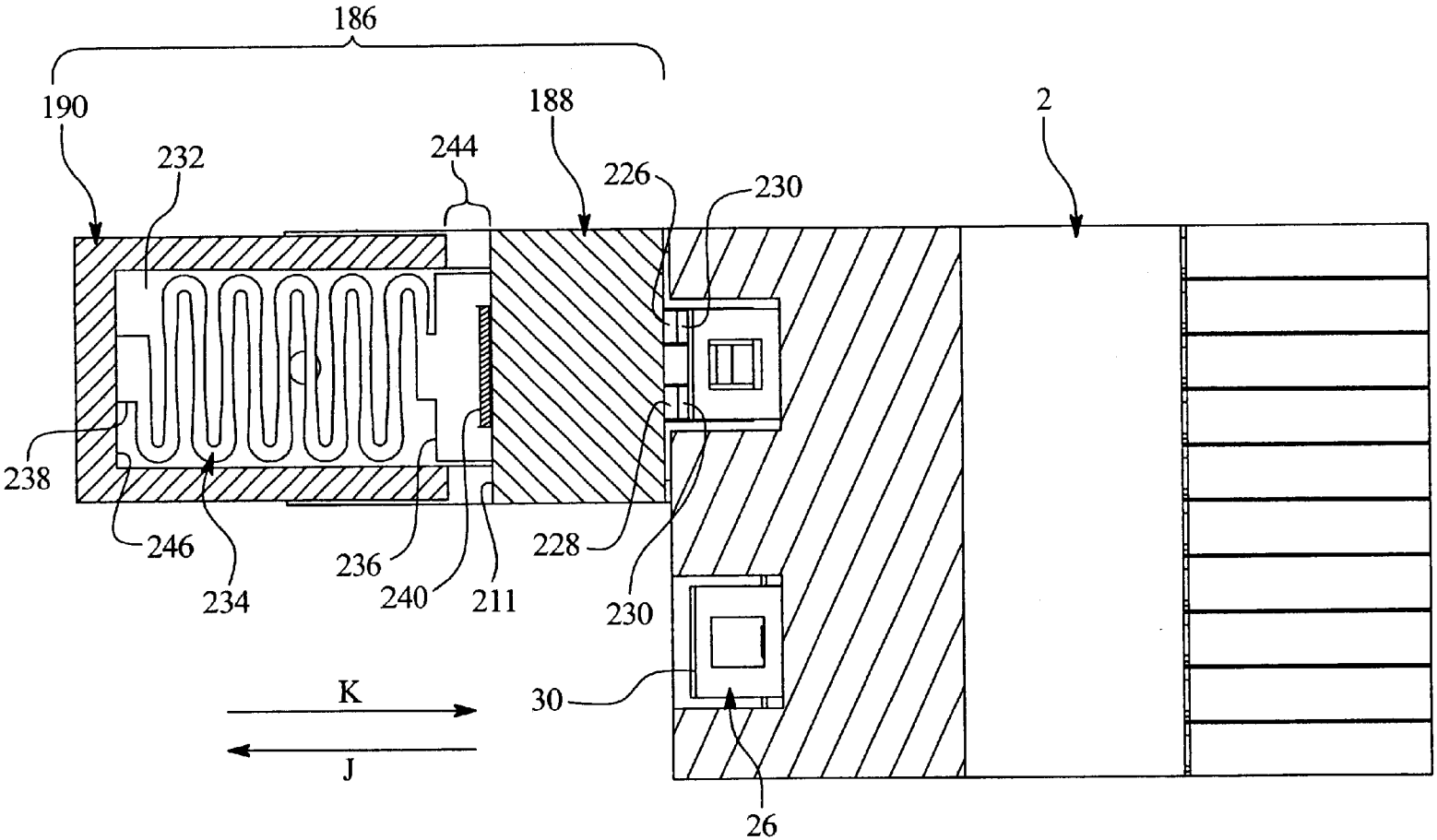
FIG. 14 illustrates a cross sectional view of the receptacle and header assemblies taken along line 14—14 in FIG. 12.

FIG. 14 illustrates a cross-sectional view of the header assembly 2 mated with the receptacle assembly 186 taken along line 14—14 in FIG. 12. The spring-loading chamber 232 includes a rear wall 246 that abuts against the rear tab 238 of the spring 234. When the push housing 190 is pushed in the direction of arrow K, the chamfered ends 230 of the beams 226 and 228 slide under the upwardly curved rear edge 30 and lift the cantilever latch 26. Also, when the push housing 190 is pushed in the direction of arrow K, the gap 244 closes and the rear wall 246 of the spring-loading chamber 232 and the rear wall 211 of the front housing 188 compress the spring 234. When the push housing 190 is released, the spring 234 recoils, returning the push housing 190 rearward in the direction of arrow J.

Figure 15:
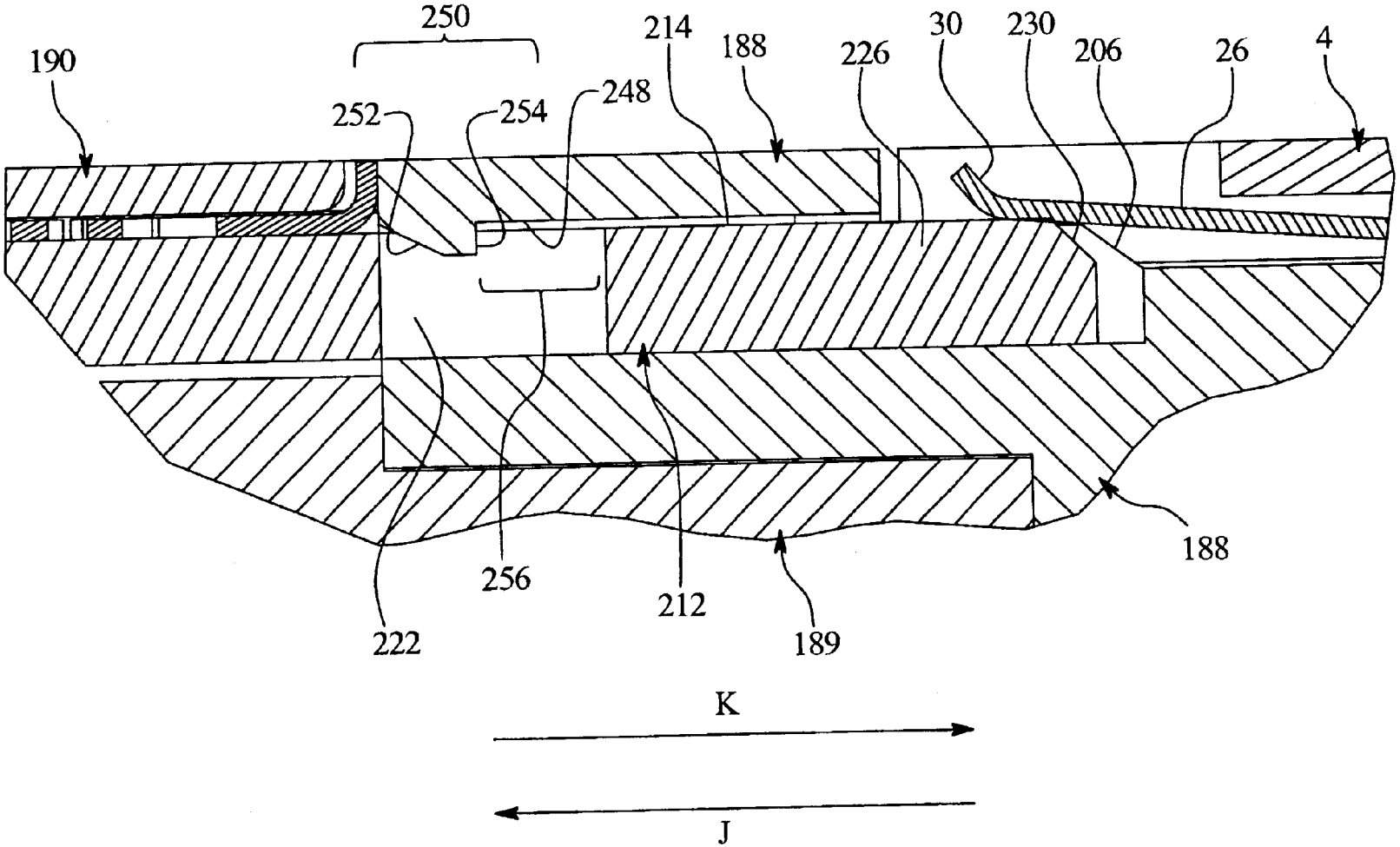
FIG. 15 illustrates a cross sectional view of portions of the receptacle and header assemblies taken along line 15—15 in FIG. 13.

FIG. 15 illustrates a detailed cross-sectional view of the beams 226 and 228 lifting the cantilever latch 26 taken along line 15—15 in FIG. 13. The chamber 213 includes a ceiling surface 248 having a pair of teeth 250 (only one tooth 250 is shown in FIG. 15) extending downward therefrom. The teeth 250 have rear ramped surfaces 252 and front walled surfaces 254. When the push housing 190 is mated with the front housing 188, the rear ramped surfaces 252 slide over the top surface 214 of the mating portion 212. Once the push and front housings 190 and 188 are mated, the teeth 250 partially occupy the channels 222 and 224 of the mating portion 212. The front walled surfaces 254 of the teeth 250 prohibit rearward movement of the push housing 190 in the direction of arrow J beyond a distance 256, thereby preventing unmating of the push and front housings 190 and 188.

As the push housing 190 moves forward in the direction of arrow K, the push housing 190 pushes the beams 226 and 228 forward. Consequently, the chamfered ends 230 slide forward under the upwardly curved rear edge 30 of the cantilever latch 26, causing the cantilever latch 26 to be raised above the tooth 206. While the push housing 190 pushes the beams 226 and 228 forward, the push housing 190 also pushes the rear tab 238 of the spring 234, thereby compressing the coil 242. Once the forward force on the push housing 190 is removed, the coil 242 causes the push housing 190 to recoil in the direction of arrow J to the locked position (shown in FIG. 12).

While certain embodiments of the present invention employ a right angle header assembly, other embodiments may include other types of header assemblies, such as vertical header assemblies.

While certain embodiments of the present invention employ the header assembly having the cantilever latch and the receptacle assembly having means for lifting the cantilever latch, other embodiments may employ the receptacle assembly having the cantilever latch and the header assembly having means for lifting the cantilever latch.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly comprising:

a first connector housing including a stationary arm fixed thereto and a release arm moveable with respect to said stationary arm, said first connector housing further including a driving member driving said release arm with respect to said stationary arm from a first position to a second position and a release arm-spring member for biasing said release arm toward said first position; and a second connector housing mateable with said first connector housing, said second connector housing including a moveable latch mateable with said stationary arm when said first and second connector housings are joined, said moveable latch being moved by said release arm from a locked position to a released position, said moveable latch being biased toward said locked position, said stationary arm locking with said moveable latch when said moveable latch is in said locked position, said stationary arm being released from said moveable latch when said moveable latch is in said released position.

2. The electrical connector assembly of claim 1, wherein said stationary arm includes a stopping projection extending perpendicularly from said stationary arm and having a ramped front surface and a walled rear surface.

3. The electrical connector assembly of claim 1, wherein said release arm comprises a slidable arm that is moveable along a linear direction parallel to a mating direction along which said first and second connector housings move when being joined with one another, said slidable arm engaging and releasing said moveable latch when moved in said mating direction.

4. The electrical connector assembly of claim 1, wherein said release arm is in said first position when said moveable latch is in said locked position, and said release arm is in said second position when said moveable latch is in said released position.

5. The electrical connector assembly of claim 1, wherein said release arm comprises a lever rotatable about an axis between said first and second positions, said lever deflects said moveable latch toward said released position when said lever rotates.

6. The electrical connector assembly of claim 1, wherein said release arm comprises a slidable arm that is moveable along a linear direction parallel to a mating direction along which said first and second connector housings move when being joined with one another, said slidable arm engaging and releasing said moveable latch when moved along said linear direction.

7. The electrical connector assembly of claim 1, wherein said release arm comprises a flexible arm, said flexible arm deflects said moveable latch toward said released position when said flexible arm bends from said first position to said second position.

8. The electrical connector assembly of claim 1, wherein one of said first and second connector housings further includes a plurality of contacts and a plurality of cables extending from said contacts.

9. The electrical connector assembly of claim 1, wherein said release arm comprises a lever rotatable about an axis between said first and second positions, said lever deflects said moveable latch toward said released position when said lever rotates, said stationary arm including a stopping projection extending perpendicularly from said stationary arm along a direction corresponding to a pivoting direction along which said lever rotates.

10. The electrical connector assembly of claim 1, wherein said release arm comprises a lever rotatable about an axis between said first and second positions, said lever including a first end located proximate said stationary arm, said first end being moved along an arcuate path to drive said moveable latch to said released position.

11. An electrical connector assembly comprising:

a first connector housing including a stationary arm fixed thereto and a slidable arm that is moveable with respect to said stationary arm along a linear direction parallel to a mating direction along which said first connector housing and a second connector housing move when being joined with one another, said first connector housing further including a driving member moving said slidable arm with respect to said stationary arm from a first position to a second position and a slidable arm-spring member for biasing said slidable arm toward said first position; and said second connector housing mateable with said first connector housing, said second connector housing including a moveable latch mateable with said stationary arm when said first and second connector housings are joined, said moveable latch being moved by said slidable arm from a locked position to a released position, said moveable latch being biased toward said locked position, said stationary arm locking with said moveable latch when said moveable latch is in said locked position, said stationary arm being released from said moveable latch when said moveable latch is in said released position.

12. The electrical connector assembly of claim 11, wherein said stationary arm includes a stopping projection extending perpendicularly to a direction along which said slidable arm moves.

13. The electrical connector assembly of claim 11, wherein said slidable arm engages and releases said moveable latch when moved in said mating direction.

14. The electrical connector assembly of claim 11, wherein said slidable arm is in said first position when said moveable latch is in said locked position, and said slidable arm is in said second position when said moveable latch is in said released position.

15. The electrical connector assembly of claim 11, wherein said slidable arm has a ramped front surface engaging said moveable latch in said locked position and lifting said moveable latch to said released position.

16. The electrical connector assembly of claim 11, wherein one of said first and second connector housings further includes a plurality of contacts and a plurality of cables extending from said contacts.

* * * * *